US006713966B2

(12) United States Patent
Shultz et al.

(10) Patent No.: US 6,713,966 B2
(45) Date of Patent: Mar. 30, 2004

(54) EVENT AND ARC DETECTION IN LAMPS

(75) Inventors: Gil Shultz, Northville, MI (US); Ben Flaster, Ypsilaniti, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/151,175

(22) Filed: May 21, 2002

(65) Prior Publication Data

US 2003/0218426 A1 Nov. 27, 2003

(51) Int. Cl.[7] ..... H05B 37/02

(52) U.S. Cl. ..... 315/77; 315/86; 315/225; 315/64

(58) Field of Search ..... 315/119–136, 64, 315/65, 93, 94, 77, 82, 86, 225, 247, 100; 362/92–94

(56) References Cited

U.S. PATENT DOCUMENTS 3,710,367 A * 1/1973 Barnum ..... 340/251
3,745,896 A * 7/1973 Sperti et al. ..... 315/247
4,100,586 A 7/1978 Cronin
4,151,445 A 4/1979 Davenport et al.
4,315,196 A 2/1982 Kitayama
4,550,303 A 10/1985 Steele
4,810,936 A 3/1989 Nuckolls et al.
4,897,573 A 1/1990 Ooms
4,937,497 A * 6/1990 Osawa et al. ..... 315/77
5,061,879 A 10/1991 Munoz et al.
5,194,779 A * 3/1993 Segoshi et al. ..... 315/82
5,389,857 A * 2/1995 Abbott et al. ..... 315/94
5,521,466 A * 5/1996 Vincent ..... 315/77
5,768,898 A * 6/1998 Seok et al. ..... 362/92

* cited by examiner

*Primary Examiner*—Don Wong
*Assistant Examiner*—Wilson Lee
(74) *Attorney, Agent, or Firm*—Sughrue Mion, PLLC

(57) ABSTRACT

A power supply system has a battery for supplying power and a lamp having a plurality of filaments therein. Each of the filaments is connected to the battery through a filament power feed line, respectively. A switch is provided on each of the filament power feed line. A fault detection circuit measures a current that flows in a non-active filament and generates a fault signal that shuts off the switch for the filament when the current flows in the non-active filament.

19 Claims, 4 Drawing Sheets

Equivalent Circuit

EVENT AND ARC DETECTION IN LAMPS

BACKGROUND OF THE INVENTION

1. Field of the Invention

This invention relates to a multiple filament lamp, and more particularly to a PWM-controlled 12V-multi filament automotive lamp supplied by a 42V power net system which has a power net arc detection circuit.

2. Background of Related Art

The tungsten filament of an automobile lamp, for example, is contaminated with iron. This contamination is inherent in the lamp's manufacturing process. This causes the lamp to be much more likely to arc when it is new. As the lamp is operated it is considered to be seasoning. This seasoning of the lamp refers to the burning off of the iron contamination from the filament. As the lamp becomes more seasoned it is less likely to have arcing faults.

In a multi-filament lamp, when an arc occurs in the lamp it is typically between the filaments. The arc faults are from filament to filament with a voltage appearing on the un-used filament. This voltage varies quite a bit depending on the arc points on the filament. As the filament is operated (seasoned) it is changed from the metal state of tungsten to the crystalline state when cold. The crystalline state is much more brittle consequently making it more fragile as the lamp is used. As the filaments are operated (seasoned) the arcing problem is less likely to occur. It is important to realize that conventional automotive lamps were intended to operate at 16 volts or less. The threshold for arcing (UL statement) is 16V or more.

Since lamps are inherently contaminated with iron during the manufacturing processes, when the lamp is heated for the first few minutes this iron boils off. This conductive iron vapor can and does reach the other filament to form a current path. Typically, both filaments have a common connection and separate power feed lines, as shown in FIG. 1A. When this 'short' occurs due to iron boil off, energy is transferred from the operating filament to the non-operating filament as well. Then, the operating filament is vaporized and destroyed.

The equivalent circuit, in the event of a short, is shown in FIG. 1B, where FIG. 1B illustrates the operating filament and a portion of the non-operating filament. With more current flowing through a smaller piece of filament [FC] it gets very hot and melts, resulting in failure. The other part of the short is illustrated as two filament portions in parallel relative to the common connections.

The conventional multiple filament lamps have many problems protecting the lamp filaments and do not offer any arc protection for new filaments contaminated with iron.

Accordingly, this invention addresses the arcing problem associated with PWMing 12V multi filament automotive lamps, especially from the 42V power net system, and these same lamps operating on 12V systems. It is an object of the invention to provide a multiple filament lamp arc detection circuit which detects the start of an arc in the multiple filament lamp, especially in higher voltage systems such as power net, and enables the driver circuitry for the lamp to turn off the lamp, before damage occurs to a multiple filament lamp. Such multi-filament lamps include headlamps and any multiple lamps, such as brake lights, taillights, tail lamps. This invention is also applicable whether the lamp is driven from a higher voltage, PWM or not. As an alternative, lamp protection can be provided by reducing the applied voltage to below an arcing level. While arcs are more likely occur in new filaments, even seasoned lamps may undergo arcing and other fault events. The invention is also applicable to prevent lamp failure under these conditions.

SUMMARY OF THE INVENTION

The present invention solves the above problems by measuring the voltage rise in the non-operating filament and detecting the occurrence of the arc in the lamp. The measurement then becomes the fault signal which, in turn, causes the drive circuitry to turn off the lamp or attenuate a voltage applied to filaments to prevent the filament from vaporizing and destroying the lamp, and thereby extinguishing the initial arc before serious damage can occur. This will also detect an arc during normal operation of the lamp and generate the fault signal.

This solution is easy to implement while requiring no additional vehicle wiring. Additional vehicle wiring utilized in other solutions is expensive and ranges from $0.50 to over $1.00 per cut lead. Multiply this by millions of vehicles and alternative solutions cost manufacturers a lot of money. Warranty cost associated with replacing failed lamps is very expensive. This invention thus will lower the warranty replacement cost of multiple filament lamps. Depending on the lamp power driver design, the implementation of this invention can be both extremely easy to implement and very low in cost.

DETAILED DESCRIPTION OF PREFERRED EMBODIMENTS

Figure 1A:
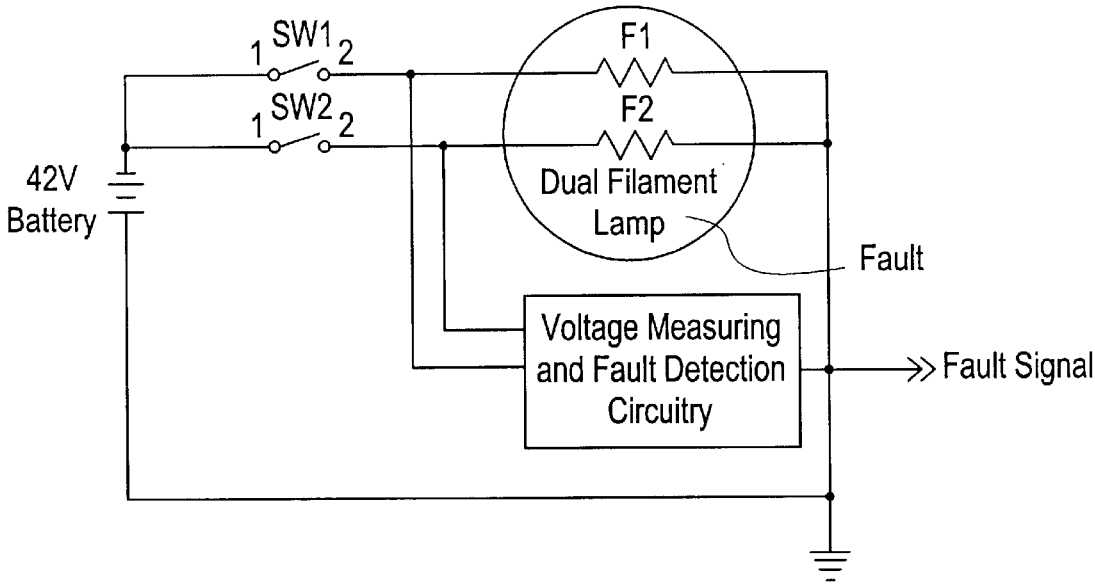
FIG. 1A is a schematic diagram of one embodiment of the multiple filament lamp having a power net arc detection circuit according to the present invention.
Figure 1B:
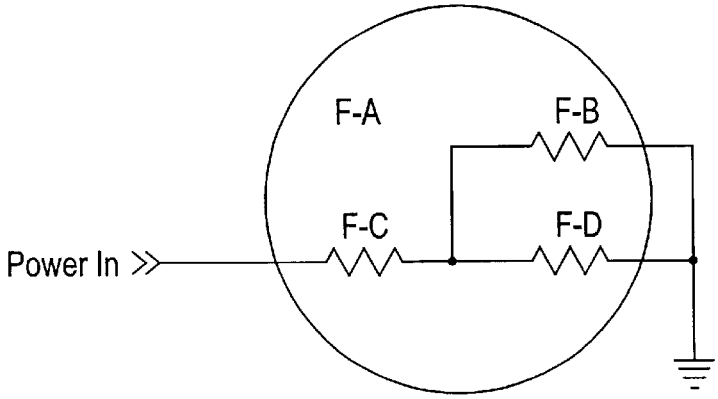
FIG. 1B is a schematic diagram illustrating a fault condition.

Preferred embodiments of the invention will now be described by way of example with reference to the accompanying drawings. In FIG. 1A, the drawing on the right shows two lamp filaments F1 and F2 in one lamp. These filaments are turned on and off by switches SW1 and SW2. The 42V battery, which represents the 42V system, supplies power for the system. The voltage supply system can be at other voltage levels. The voltage measuring and fault detection circuitry monitors both filaments F1, F2. With appropriate logical controls, the circuit can detect which filament is active or can be commanded from another source.

During normal operation, either F1 or F2 is activated. If an arc occurs (shown as a Fault in FIG. 4), this electrically connects both filaments F1, F2 together at some point typically other than the end points, causing an excessive current flow in the non-parallel path of the filament (due to the arc). This causes the filament to overheat and melt, and destroys the lamp. This path created at the start of the arc is detectable by monitoring the voltage on the inactive filament power feed line.

When the rise in voltage in the non-active filament is detected, a fault signal is generated. This fault signal is fed to the drive circuitry (not shown) via the fault signal, which in turn, turns off the power to the filament for a finite amount of time allowing the arc to extinguish and the cause of the fault to dissipate.

Figure 2:
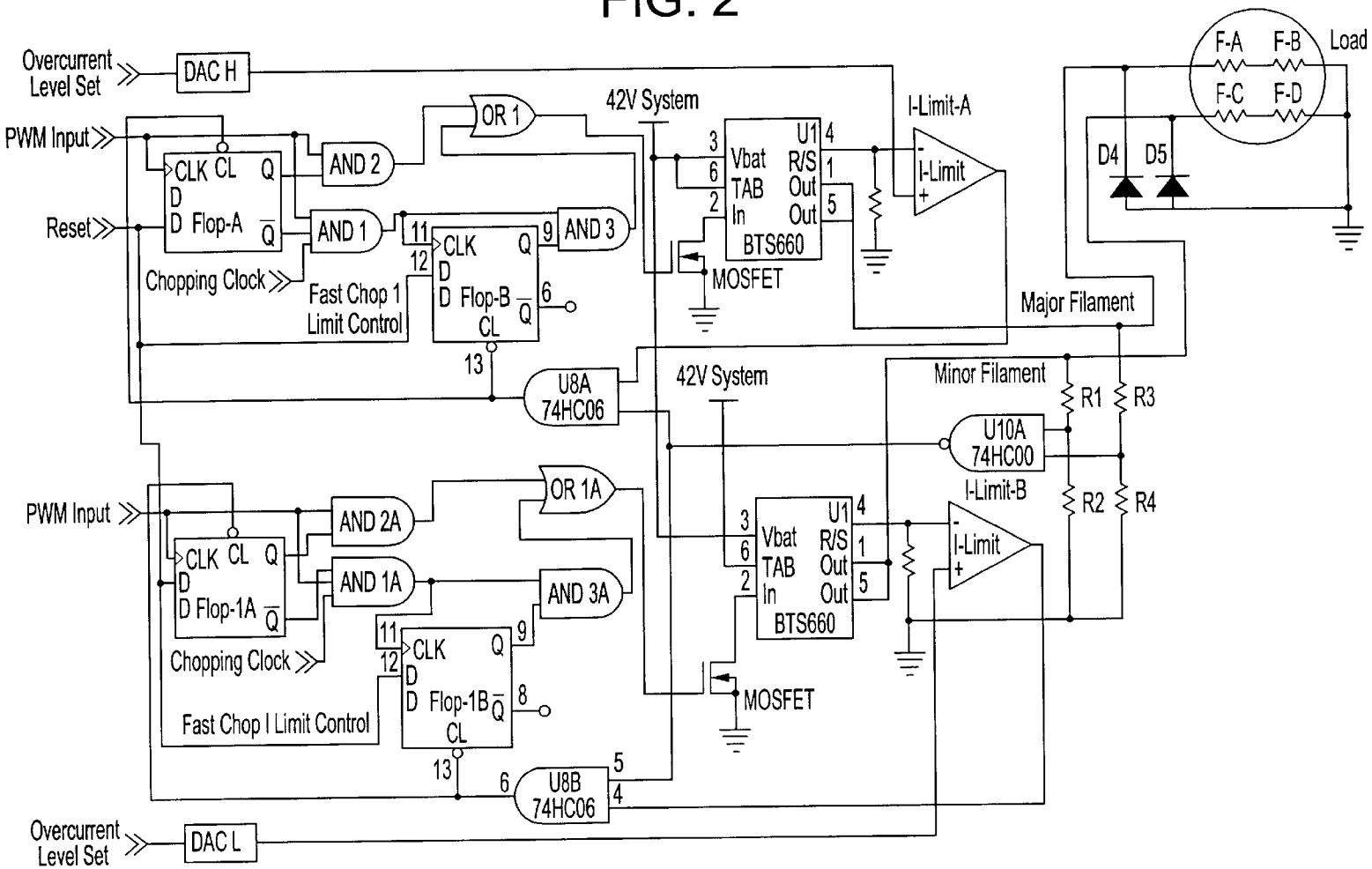
FIG. 2 is a circuit diagram of the multiple filament lamp according to the present invention.
Figure 3:
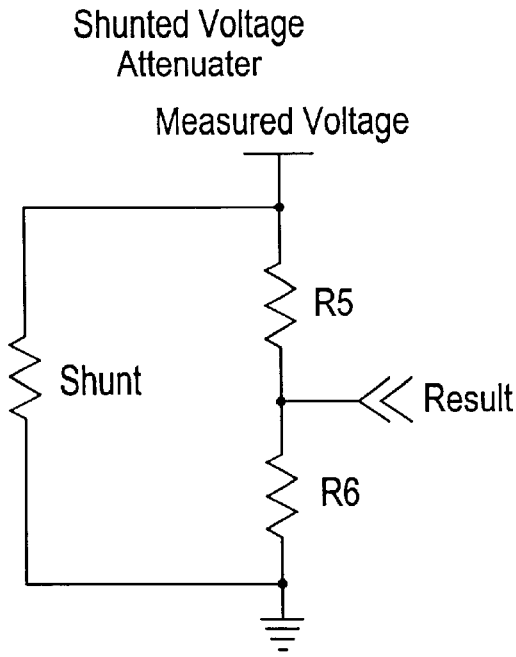
FIG. 3 is a voltage attenuator applied to the circuit diagram of FIG. 2.
Figure 4:
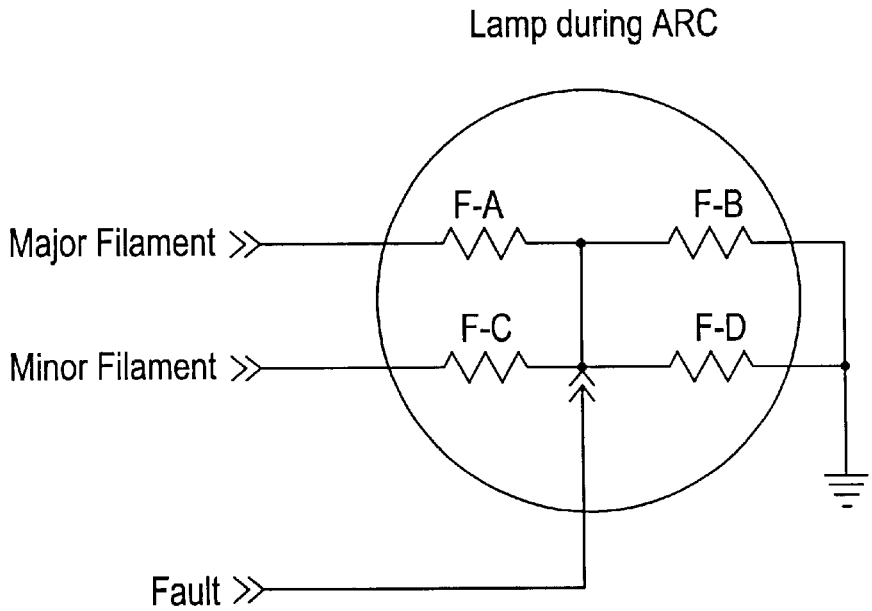
FIG. 4 shows a schematic diagram of the lamp during arc.

Referring to FIGS. 2–4, circuit operation of a preferred embodiment of the drive circuitry will now be described.

High Beam:

The temperature of the filament is directly related to the current drawn at a given voltage. Tungsten, the primary filament material, has a positive temperature coefficient. This correctly indicates that its resistance will rise as the temperature does. This filament resistance can be calculated, measured and or inferred from the current flowing through the filament at a known voltage. This current requirement [filament temperature] can be measured or determined empirically. The resistance is relatively constant from lamp to lamp of the same type so a table, offset, or simple calculations can be used to set the current (filament temperature). Temperature of the filament can be measured by sending a pulse to the filament and measuring the wattage (volts * amps), resistance (volts/amps) and comparing to a table or calculating the results. The temperature of the filament has a direct correlation as to the amount of current it will require.

Halogen lamps have a gas (partially halogen) under pressure in the 'Halogen' lamps such as the headlamps and fog lamps. These lamps are much brighter primarily because the filament is operated at a much higher temperature than the typical tungsten lamp. The filaments are operating very close to their melting point. Typical tungsten lamps are operated at a much cooler filament temperature (relative to halogen) making them much more robust to voltage transients. Also tungsten filament lamps do not have the recombination cycle (halogen cycle) of the halogen lamps.

High beam or the major filament (bright lights) is typically turned on in the following sequence. The control logic sends a value to the DAC H, which limits the maximum amount of temperature rise allowed in the filament for this PWM cycle this is accomplished indirectly by limiting the current as they are proportionally related. This is implemented by limiting the peak amount of current allowed to flow into the filament. For a cold filament using a standard 50-watt halogen headlamp this would be from 35 amps to about 55 amps depending on temperature and other variables. More particularly, depending on the temperature of the filament, the current limit can conservatively be 15 times the operational current. A 55 W-5 A lamp will draw about 50 A on a 12-Volt system. The current draw at various temperatures are shown by example below. High current decreases rapidly as the filament warms up. Unless the FET is protected or sized, heavy current under a cold condition will take the FET out of the "Safe Operating Area" (SOA) causing the FET to eventually fail. By sending a short pulse to the filament, and knowing the voltage a priori it is possible to determine the filament temperature.

Examples:

Normal: 5 A @ 12V=2.4 Ohm 2.4 Ohm @ 42V=17.5 A

Cold about 0C (guess)

Cold: 50 A @ 12V=0.24 Ohm 0.24 Ohm @ 42V=175 A

Real Cold about −40C

Real Cold: 75 A @ 12V=0.16 Ohm 0.16 Ohm @ 42V= 262.5V

The temperature information can be used to determine how to PWM the input pulse. Short duration pulses, under careful control, can be used in the cold operating state of a filament and once the filament reaches a certain operating temperature, a wider pulse can be used.

The rising edge of the PWM pulse applied to the clock input of 'D Flop-A' turns on 'D Flop-A': the 'D' input is connected to reset, which is an active low ('0') only during reset, consequently it is high during normal operation, clocking in a logic '1'. The 'Q' output of 'D-Flop-A' is 'anded' with the PWM input pulse. The output of 'AND 2' is then fed to 'OR 1' with the output of 'AND 3'. 'D Flop-A' guarantees that only one of the two 'AND' gates are enabled at any given time. This is accomplished because 'Q' and 'Q\' outputs are always the complement of each other. 'D Flop-B' serves to turn off the power drive during a chopping clock cycle which occurs only after a fault has occurred on the original PWM cycle The error can be either a current fault or ARC fault, although typically it would be a current fault. The chopping cycle remains active during the remaining of the original PWM on pulse, this allows the filament to continue to be heated but at a reduced rate. The chopping clock can be PWM or square wave, this would be application-independent and/or engineer preference.

The output of the 'OR 1' gate feeds the gate of the MOSFET which is a voltage-current translator for the BTS660 highside driver. The BTS660 has a current sink requirement to turn it on, not a voltage input, therefore it has no ground connection other than via the load and/or control input. The BTS660 turns on driving pins 1 & 5 high, which are connected, to the voltage attenuater composed of R3 and R4 and the Major filament of the lamp. 'D4' is used to provide a path for inductive currents, allowing inductive loads such as motors to be connected to the output. A FET transistor, IGBT or other device can be used in place of the BTS660.

The center tap of the voltage attenuater is connected U10A. The output of this attenuater although not shown is also used by the logic to measure the output pulse width allowing for delayed or real time compensation of the 'turn-on' and 'turn off' delays of the output driver and associated circuitry. The logic is operating at about 3VDC. This places the logic threshold of the 'NAND" U10A at about 1.2VDC Low and 1.8VDC High. If greater sensitivity is needed a comparator can be used.

The 'Voltage Attenuater' as shown in FIG. 3 is critical to the operation of this circuit. The voltage applied to the output of the BTS660 and the ratio of R3 and R4 determines the voltage applied to the input of U10A (threshold setting). This pair of resistors divides the output voltage to a level the logic can use and more importantly determines the logic threshold of the output voltage The present embodiment uses a value of four volts for the trip point and a minimum system voltage of 20 volts DC. Assuming the logic is operating at three volts DC and is CMOS, then the trip points are VCC * 0.4 for a logic '0' and VCC * 0.6 for a logic '1'. Therefore a logic '0'equals 1.2 Volts and a logic 1 equals 1.8V. Then the system voltage 20 volts divided by the trip point four volts gives a resistor ratio of five to one. The worst case system voltage would be a little below sixty volts so, 60 volts is used. The system will be placed in a 85C ambient.

The CMOS input protection logic clamp voltage is 3 volts. Therefore it is possible to use 60 volts—three volts or 57 volts worse case fault voltage. The maximum input current protection value is 20 mA follow a rule of thumb, no more then ten percent of that value or 2 mA should be injected into the CMOS device. Therefore per Ohm's Law (E/I) 57 Volts/0.002 equals 28,500 ohms for the network. 28,500 divided by the ration sum 6 equals 4750. 1*4,750=

4,750 Ohms and 5*4,750=23,750 Ohms. To be on the safe side the 4,750 is rounded up to 5100 ohms the next standard 5% resistor value and the next value greater then 23,750 Ohms is 24,000 Ohms. This gives a total resistance of 24,000+5,100 or 29,100 Ohms. The ratio is 24,000:5100 or 4.705 to one, which is close enough for this application. Maximum sensitivity without using a comparator is achieved by not installing R6.

The next item is the wattage value of the resistor, which is easily determined by one skilled in the art in accordance with Ohm's law.

The bottom resistor in the Voltage Attenuater 'R4' also serves the purpose of a pull down resistor for the gate input. This guarantees that if the load were to open a logic fault would not be generated. CMOS devices tend to drift to mid supply, which is an invalid or un-known logic state.

Inherent in the design of semiconductor devices is an input protection network. This network typically has diodes which clamp the input to the VCC (+) and ground supply. In effect this clamps the input to approximately the logic plus and ground power supplies. This clamping network has a maximum rating, which cannot be exceeded. The 'Voltage Attenauater' absolute resistance values control the amount of current that is allowed to flow into this protection network. It is typically good design practice to set current injection to less then 10% of the maximum current rating in to protect the network under worse case conditions. This gives a good safety margin allowing reliable operation of the device.

If the temperature of the filament is too low for the pulse time, the 'I-Limit' comparator will go from a logic '1' one to a logic '0' state. This forces 'U8A to go to a logic '0' low thereby causing 'D-Flop-A' to clear and turn off 'AND 2' and enable 'AND 1'. This in effect changes the PWM sourced (clock) to the 'Chopping Clock'. The edges of the PWM and Chopping clocks are edge synchronized to prevent the possibility of extending the pulse on time and possibly destroying the filament.

The 'NAND' 'U10A' operates such that it needs both inputs to be logic '1'(one) to cause its output to go to a logic low '0'. When the 'NAND' goes active to a logic '0' if forces 'D Flop-A' and 'D Flop-B' to clear turning off the power to the major (high beam) and minor (low beam) filaments until the next rising edge of the PWM input. This causes 'I-Limit' to reset to a logic one '1'. Clearing of D Flop-A transfers the PWM source to the chopping clock for the remainder of the current PWM cycle.

For the duration of the 'ON" state of the PWM pulse 'D Flop-B is now in control of the PWM pulse. The system logic creates a rapid PWM pulse, which can be faster, slower, or the same as the original PWM pulse.

During normal operation the PWM pulses to the major and minor filaments are non-overlapping even if the flash to pass is enabled on a headlamp system. This non-overlapping drive serves several purposes, first to balance the peak load on the 42-volt system. Second it prevents both inputs of the 'NAND' 'U10A' from being a logic '1' during normal operation. If the voltage is so low that they overlap the odds of arcing are minimized and the protection may not be needed and therefore can be disabled for that cycle(s) in many applications.

In FIG. 4, labeled 'Lamp during ARC' shows that the filaments as pseudo resistors. When an ARC forms it will form a conductive path between the two filaments, with the contact points between the filaments being unpredictable at the current time. The fault in FIG. 4 shows a short between junction of resistors 'F-A' and 'F-B' shorted to the junction of resistors 'F-C' and 'F-D'. The absolute value of the pseudo resistors is dependent on the fault points.

Assuming the major filament F-A and F-B is active, pseudo resistors 'F-B' and 'F-D' are connected in parallel appreciable lowering the effective resistance. This causes an excess of power to be dissipated across pseudo resistor 'F-A' causing it to fail. The failure is not instantaneous, and if the power is turned off quickly enough the filament can be saved.

During the fault condition there is a voltage generated across pseudo resistors 'F-B' and 'F-D'. This voltage is also present on both ends of pseudo resistor 'F-C'. The power input to the minor filament (pseudo resistor 'F-C') is open during this PWM cycle, consequently that terminal will also have the voltage generated by the pseudo resistors 'F-B' and 'F-D'. This voltage is placed on 'U10A' as a logic '1'. The second input to 'U10A' is also a logic '1' because of the PWM 'on' state driving the major filament. This fault condition causes the output of the 'NAND' 'U10A' to go to a logic '0' resetting the flops 'D Flop-A' and 'D Flop-B' shutting down the current to the lamp. For the remainder of the current PWM on signal the 'chopping clock' becomes the source of the PWM clock. This allows a lower amount of energy to be driven into the filament to help warm it up faster. In particular, by using a lower duty cycle pulse less energy is input into the lamp the same effect as attenuating would have.

Low Beam:

Low beam or the minor filament (dim lights) is typically turned on in the following sequence. The control logic sends a value to the DAC L, which limits the maximum amount of temperature rise allowed in the filament for this PWM cycle. This is implemented by limiting the peak amount of current allowed to flow into the filament. For a cold filament using a standard 50-watt halogen headlamp this would be from 35 amps to about 55 amps depending on temperature and other variables.

The rising edge of the PWM pulse applied to the clock input of 'D Flop-1A' turns on 'D Flop-1A': the 'D' input is connected to reset\ which is an active low ('0') only during reset, consequently it is high during normal operation).

The 'Q' output of 'D-Flop-1A' is 'anded' with the PWM pulse. The output of 'AND 2A' is then fed to 'OR 1A' with the output of 'AND 3A'. 'D Flop-1A' guarantees that only one of the two 'AND' gates are enabled at any given time. 'D Flop-B' serves to turn off the power drive during a fast chop cycle which occurs only after a fault has occurred on the original PWM cycle.

The output of the 'OR 1A' gate feeds the gate of the MOSFET which is a voltage-current translator for the BTS660 highside driver. The BTS660 has a current sink requirement to turn it on, not a voltage input, therefore it has no ground connection other then via the load. The BTS660 turns on driving pins 1 & 5 high, which are connected, to the voltage attenuater composed of R1 and R2 and the Minor filament of the lamp. 'D5' is used to provide a path for inductive currents, allowing inductive loads such as motors to be connected to the output.

If the temperature of the filament is to low for the pulse time, the 'I-Limit' comparator will go from a logic '1' one to a logic '0' state. This forces 'U8B to go to a logic '0' low thereby causing 'D-Flop-1A' to clear and turn off 'AND 2A' and enable 'AND 1A'. This in effect changes the PWM sourced (clock) to the 'Chopping Clock'. The edges of the PWM and Chopping clocks are edge synchronized to prevent the possibility of extending the pulse on time and possibly destroying the filament.

The 'NAND' 'U10A' operates such that it needs both inputs to be logic '1' (one) to cause its output to go to a logic low '0'. When the 'NAND' goes active to a logic '0' if forces 'D Flop-1A' and 'D Flop-B' to clear turning off the power to the major (high beam) and minor (low beam) filaments until the next rising edge of the PWM input. This causes 'I-Limit' to reset to a logic one '1'. Clearing of D Flop-1A transfers the PWM source to the chopping clock for the remainder of the current PWM cycle.

For the duration of the 'ON" state of the PWM pulse 'D Flop-B in now in control of the PWM pulse. The system logic creates a rapid PWM pulse, which can be faster, slower, or the same as the original PWM pulse.

During normal operation the PWM pulses to the major and minor filaments are non-overlapping even if the flash to pass is enabled on a headlamp system. This non-overlapping drive serves several purposes, first to balance the peak load on the 42-volt system. Second it prevents both inputs of the 'NAND' 'U10A' from being a logic '1' during normal operation. If the voltage is so low that they overlap the odds of arcing are minimized and the protection may not be needed and therefore can be disabled for that cycle(s) in many applications.

There is some high frequency signal present on the un-used filament and the driven filament during an arcing condition. The approach of voltage determination is much more cost efficient than trying to analyze the frequency generated and make a decision that the arcing is taking place.

It should be noted that the circuit allows a controlled start by limiting the wattage into the filament by profiling the turn on ramp cycle. The wattage limitation can be implemented by using a resistor, a extra length of wire, smaller diameter of wire or many other methods. This invention prevents the filament from getting hot enough to get soft and or melt. The filament is a super helix (a coiled spring) and has a tension trying to separate the filament. This tension is inherent and mechanical by mechanical design. This characteristic helps the filament to separate (break) when it gets to hot.

Though a preferred embodiment of the invention has been set forth above where the control is implemented with a PWM system. This is the intended application but the control is not limited to this method of operation. PWM by its very nature is digital in nature, consequently this design was based on digital logic minimizing the analog portion as much as possible.

In addition, in the above embodiment, the main logic of this design is implemented with hardware and a microcontroller. This is a convenient but not necessary solution. The controls could be implemented with hardware, with a microcontroller only, custom part, or any combination deemed necessary by the designer. Other logic combinations can be used to control the driver circuitry for the filaments.

Further, only one output/input channel has been explained although there could and typically are many different outputs and inputs in a system. The inductive nature of the vehicle wiring could probably be ignored but good design practice dictates that we should protect the electronics from the transients etc. it could cause. This gives us inherent side benefits that by the proper selection of the clamp diodes ('D4' and 'D5') this circuit will be able to drive an inductive load such as would be able to PWM motors, solenoids and other type of inductive loads.

Furthermore, not shown is the ability to control the voltage into the lamp during start, stop and operation conditions. Although not in detail on the drawing this is accomplished by changing the voltage on the '42V System' supply. If the driver were of discrete design it could also be accomplished by changing the gate drive voltage when using a source follower configuration for the output FET. This is shown as 'Variable Gate Voltage Drive' insert in the drawing.

Figure 5:
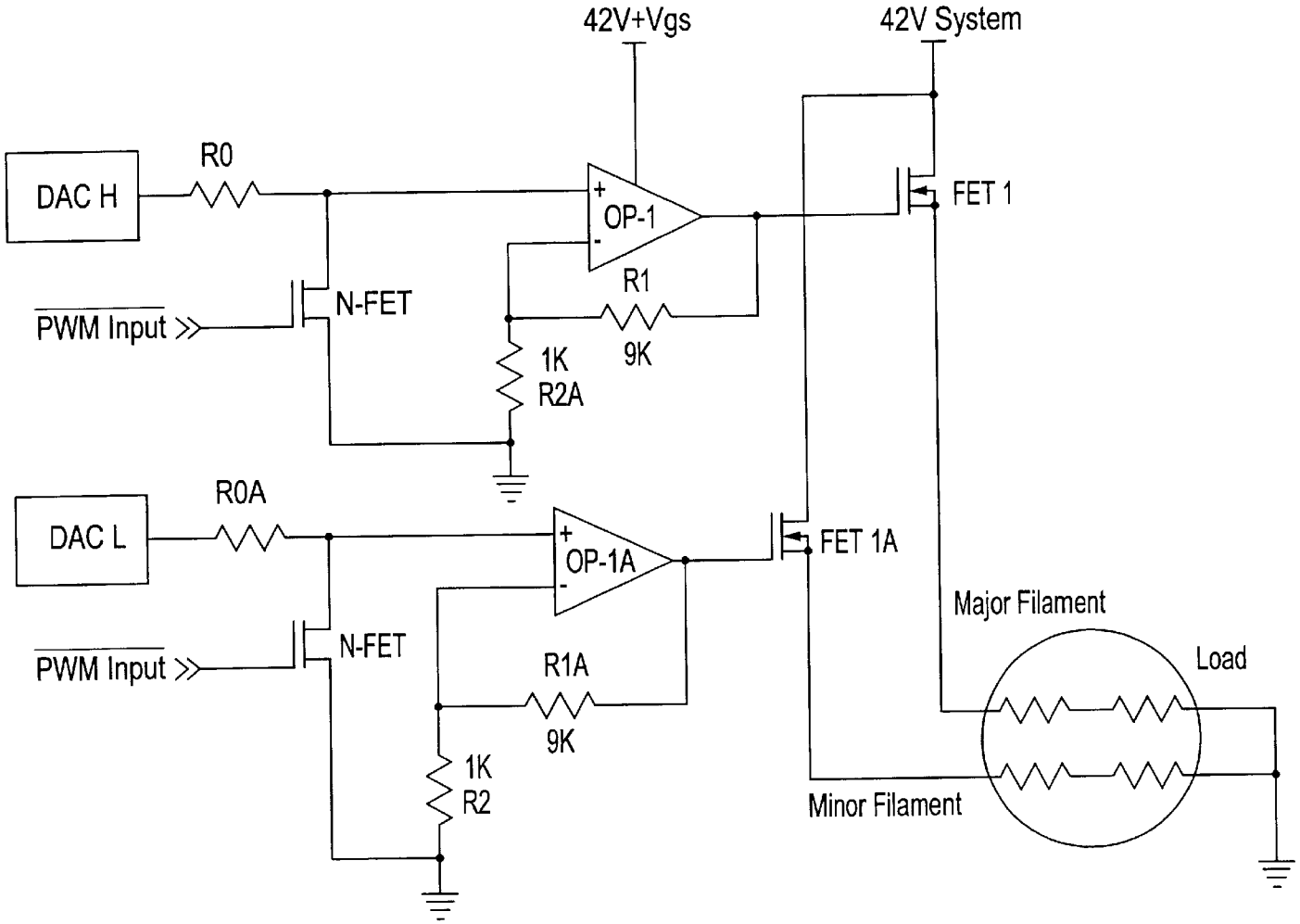
FIG. 5 shows a schematic diagram to show a simplication of a variable gate drive shown in FIG. 2.

FIG. 5 shows a simplication of variable drive shown in FIG. 2. FET 1 & FET 1A are configured in a source follower configuration. This is typical when using 'N' channel FETs in a high side switching configuration. The drain is connected to the 42V system, the load is connected to the source. The voltage at the source is approximately the same as the voltage applied to the gate. When the gate voltage goes above the source by a few volts the MOSFET becomes enhanced which is the low resistance mode. At this point the source voltage cannot exceed the drain voltage. The gate drive voltage can be derived from a charge pump or other means deemed desirable. In this case, the gain is 10. The DAC is capable of outputting 0–5 VDC, multiplying that by 10 gives a maximum output of 50V. The output voltage range is therefore 0 to 50VDC, more then enough for a maximum of 48 volt operation. When the gate of the N-FET is high the FET is turned on forcing the input of the gain block to zero. The N-FET is fed with the negated output of the PWM signal. The output would start at about 12V and be ramped up to the system voltage as the filament was warmed up. The starting voltage is arbitrary and dependent on system parameters.

What is claimed is:

1. A power supply system, comprising:

a battery for supplying power;

a lamp having a plurality of filaments therein, each of said filaments connected to said battery through a filament power feed line, respectively;

a switch provided on each of said filament power feed lines; and a fault detection circuit measuring a current that flows in a non-active filament of said plurality of filaments and generating a fault signal that shuts off the switch for the filament when the current flows in said non-active filament.

2. The power supply system according to claim 1, further comprising a pulse width modulation control unit that applies a signal to supply current to said fault detection circuit.

3. The power supply system according to claim 1, wherein said switch is a transistor.

4. The power supply system according to claim 1, further comprising a clamp diode connected between said filament feed line and ground.

5. The power supply system according to claim 1, wherein said fault detection circuit includes one or more logic gates.

6. The system of claim 1, wherein a first filament of said plurality of filaments is connected to a first power feed line via a first switch, and a second filament of said plurality of filaments is connected to a second power feed line via a second switch.

7. A power supply system, comprising:

a battery for supplying power;

a lamp having a plurality of filaments therein, each of said filaments connected to said battery through a filament power feed line, respectively;

a switch provided on each of said filament power feed lines;

a measurement means for measuring a voltage measurement across a non-active filament of said plurality of filaments; and a fault detection means for comparing a reference voltage with said voltage measurement and shutting off the switch for the filament when the voltage measurement is more than a threshold value of said reference voltage.

8. A power supply system, comprising:

a battery for supplying power;

a lamp having a plurality of filaments therein, each of said filaments connected to said battery through a filament power feed line, respectively;

a switch provided on each of said filament power feed lines;

a measurement means for measuring a voltage measurement across a non-active filament of said plurality of filaments; and a fault detection means for comparing a reference voltage with said voltage measurement and attenuating a voltage applied to said filaments when the voltage measurement is more than a threshold value of said reference voltage, without shutting off the filament.

9. The power supply system according to claim 7, further comprising a pulse width modulation control unit that applies a signal to said fault detection means.

10. The power supply system according to claim 8, further comprising a pulse width modulation control unit that applies a signal to said fault detection means.

11. The power supply system according to claim 7, wherein said switch is a transistor.

12. The power supply system according to claim 8, wherein said switch is a transistor.

13. The power supply system according to claim 8, further comprising a voltage attenuater attenuating the voltage applied to said filaments.

14. The power supply system according to claim 13, wherein said voltage attenuater comprises of a pair of resistors which determine a logic threshold of an output voltage.

15. The power supply system according to claim 7, further comprising a clamp diode connected between said filament feed line and ground.

16. The power supply system according to claim 8, further comprising a clamp diode connected between said filament feed line and ground.

17. The power supply system according to claim 1, further comprising a current detector to measure a current through the non-active filament upon application of a fixed test voltage to the non-active filament, wherein said measured current determines the voltage threshold value.

18. The power supply system according to claim 3, wherein said transistor is a variable gate drive.

19. The power supply system according to claim 11, wherein said transistor is a variable gate drive.

* * * * *